US007516599B2

(12) United States Patent
Doll et al.

(10) Patent No.: US 7,516,599 B2
(45) Date of Patent: Apr. 14, 2009

(54) METHODS AND APPARATUS FOR MANUFACTURE OF A RECLOSABLE PLASTIC CARTON

(75) Inventors: Paul Edward Doll, Madison, WI (US); Stewart Allen Armstrong, Waterloo, WI (US)

(73) Assignee: Kraft Foods Global Brands LLC, Northfield, IL (US)

( * ) Notice: Subject to any disclaimer, the term of this patent is extended or adjusted under 35 U.S.C. 154(b) by 617 days.

(21) Appl. No.: 11/268,251

(22) Filed: Nov. 7, 2005

(65) Prior Publication Data

US 2007/0102498 A1 May 10, 2007

(51) Int. Cl.
*B65B 5/02* (2006.01)
*B31B 49/02* (2006.01)

(52) U.S. Cl. ..... 53/458; 53/485; 493/152; 493/158

(58) Field of Classification Search ..... 53/382.2, 53/382.3, 452, 457, 458, 470, 485, 486, 558, 53/564; 493/152–158, 183, 309, 470; 229/106, 229/107, 125.25, 182.1
See application file for complete search history.

(56) References Cited

U.S. PATENT DOCUMENTS

| | | | | |
|---|---|---|---|---|
| 917,456 | A * | 4/1909 | Kinnard | 229/106 |
| 1,910,178 | A * | 5/1933 | Novick | 493/154 |
| 2,731,189 | A * | 1/1956 | Moore | 229/106 |
| 3,065,677 | A * | 11/1962 | Loeser | 493/158 |
| 3,348,757 | A * | 10/1967 | Hickin et al. | 229/106 |
| 3,402,876 | A * | 9/1968 | Kuchenbecker | 229/106 |
| 3,498,521 | A * | 3/1970 | Gill | 229/109 |
| 3,580,473 | A | 5/1971 | Gill | |
| 3,633,814 | A | 1/1972 | Michetti et al. | |
| 4,194,676 | A * | 3/1980 | Humphries | 229/106 |
| 4,200,219 | A | 4/1980 | Ramich | |
| 4,264,316 | A * | 4/1981 | Knudsen | 493/153 |
| 4,269,346 | A * | 5/1981 | Dutcher | 229/106 |
| 4,305,771 | A | 12/1981 | McLaren | |

(Continued)

FOREIGN PATENT DOCUMENTS

| | | |
|---|---|---|
| EP | 0 093 849 | 11/1983 |

(Continued)

OTHER PUBLICATIONS

Paper Machinery Corporation, Product Brochure, "The Big Easy Easy to Open Easy to Pour Easy to Reclose", bearing a date of Oct. 31, 2000.

(Continued)

*Primary Examiner*—Louis K Huynh
(74) *Attorney, Agent, or Firm*—Fitch, Even, Tabin & Flannery

(57) ABSTRACT

A carton formed from a unitary blank for storing food within and methods of manufacture of the carton thereform, are disclosed herein. The carton comprises a generally rectangular bottom having a pair of major bottom flaps and a pair of minor bottom flaps that are folded to form a substantially closed bottom, and a pair of major side panels, a pair of minor side panels, and a secondary side panel that are folded perpendicular to the bottom. An opening is defined by the upper ends of the major side panels and the minor side panels opposite the bottom and is generally non-rectangular.

10 Claims, 4 Drawing Sheets

U.S. PATENT DOCUMENTS

| | | | | | |
|---|---|---|---|---|---|
| 4,432,488 | A | | 2/1984 | Dutcher | |
| 4,471,901 | A | * | 9/1984 | Stahlecker | 229/106 |
| 4,564,139 | A | | 1/1986 | Reil | |
| 4,573,957 | A | * | 3/1986 | Billberg | 493/309 |
| 4,671,452 | A | | 6/1987 | Pupp et al. | |
| 4,678,456 | A | * | 7/1987 | Nigrelli, Sr. | 493/309 |
| 4,706,874 | A | | 11/1987 | Reil | |
| 4,761,156 | A | * | 8/1988 | Bachner et al. | 493/158 |
| D356,496 | S | | 3/1995 | Fox | |
| 5,472,402 | A | * | 12/1995 | Aloisi et al. | 493/158 |
| 5,492,269 | A | | 2/1996 | Sung | |
| 5,954,624 | A | * | 9/1999 | Sandstrom | 493/158 |
| 6,152,359 | A | | 11/2000 | Clark | |
| 6,170,740 | B1 | | 1/2001 | Clark | |
| 6,561,414 | B1 | | 5/2003 | Cai | |

FOREIGN PATENT DOCUMENTS

| | | |
|---|---|---|
| EP | 0 144 736 | 6/1985 |
| JP | 6-247435 | 9/1994 |
| JP | 2003-341648 | 12/2003 |
| JP | 2003-341649 | 12/2003 |

OTHER PUBLICATIONS

Paper Machinery Corporation, http://www.papermc.com/cereal.html; Printed Nov. 2, 2005; 2 Pages.

Paper Machinery Corporation, http://www.papermc.com/1300nr.html; Printed Nov. 2, 2005; 2 Pages.

* cited by examiner

50
A
B
B
100
40
46
48
44
C
C
60
42
46
44
100
50
48
42
10

METHODS AND APPARATUS FOR MANUFACTURE OF A RECLOSABLE PLASTIC CARTON

FIELD

This disclosure relates generally to a reclosable plastic carton for food products, such as cereals, snack crackers and other such foods, and methods of manufacture, and more specifically to a reclosable plastic carton that is assembled from a single carton blank.

BACKGROUND

Cereals, snack crackers, and other similar foods are typically packaged in paperboard cartons. Typical paperboard cartons do not alone protect products. As a result, the food product is commonly packaged within an inner sealed bag or liner that is placed inside the paperboard carton. To open the inner bag, the consumer must first open the box top flaps, then open the inner bag. Once this inner bag is opened, the integrity of the seal of the inner bag is lost. To reclose the bag, consumers resort to rolling the top of the bag or placing a clip or tape on the top of the bag. Carton flaps can be brought together to close the carton top, and secured using a tongue and slot connection. These options do not restore the integrity of the seal.

The typical carton and bag combination adds to the complexity in manufacturing and can increase the number of materials and steps needed to create the bag and carton combination. Furthermore, the bag forming and filling speed is often much slower than the carton forming speed, and thus may limit the speed of the total process. For example, the cartons may be formed at 250 cartons per minute, while the bags are only formed and filled at 50 bags per minute.

A plastic carton, manufactured by Paper Machinery Corporation, consists of a carton having a reclosable lid. The food product is packaged directly in the carton, without first being placed in a bag or liner. The carton is made up of two carton blanks, one blank for assembly of the carton sides and another blank for assembly of the carton bottom. However, the assembly of the bottom of the carton to the rest of the carton during manufacturing can add to the cost and complexity of manufacturing.

SUMMARY

A plastic carton formed from a unitary blank for storing food products, and methods of manufacture of the carton, are disclosed herein. The carton comprises a pair of major bottom flaps and a pair of minor bottom flaps that are folded to form a substantially closed bottom, generally rectangular, and a pair of major side panels, a pair of minor side panels, and a secondary side panel that are each perpendicular to the bottom. An opening is defined by upper ends of the major side panels and the minor side panels opposite the bottom, and is generally non-rectangular. The opening has a rim around its peripheral edges with a width greater than the thickness of the side panels. The bottom flaps are sealed to adjacent bottom flaps, and the secondary side panel is sealed to one of the other side panels to form an enclosed interior suitable for containing a food product. When used in conjunction with a lid, the carton can conveniently store food directly in its interior while eliminating the need for an additional bag liner or the like. In addition, such cartons provide for simplified reclosability to improve freshness while reducing the manufacturing time as compared to typical carton and bag combinations.

Methods of forming the carton from a unitary blank, and from a unitary blank in a collapsed configuration, are disclosed. The blank has a pair of major side panels and a pair of minor side panels. A pair of major bottom flaps and a pair of minor bottom flaps are attached to the side panels at lower ends thereof. In a collapsed configuration, a first set of the major and minor side panels are generally coplanar, and a second set of the major and minor side panels are also coplanar, with the first and second sets partially overlying or being adjacent to one another. A secondary side panel is attached lengthwise to an interior edge of one of the major and minor side panels. The collapsed blank is assembled into a carton by folding the major and the minor side panels normal to adjacent side panels and by folding the bottom flaps into configurations normal to the side panels. A heat source is applied to the bottom flaps to form seals therebetween. A heat source is also applied to the opening defined by the upper edges of the major and minor side panels to shape the upper edges into a non-rectangular periphery having a rim.

In a further aspect of the carton, the carton comprises a reclosable lid that has a channel about its periphery and on its underside for receiving the rim. A removable film may be attached to the rim and extend over the opening to provide a seal.

In a further aspect of the method, the bottom flaps may be sealed by applying a heat source from the exterior side of the carton and pressing a bottom anvil of a forming tool against the bottom flaps from the interior of the carton. The non-rectangular opening and the rim about the opening may be formed by a top mandrel of the forming tool.

DETAILED DESCRIPTION OF THE DRAWINGS

A reclosable plastic folded carton, and in particular a reclosable plastic carton used for packaging cereals, snack crackers and other similar foods, and methods of manufacture, are disclosed herein and illustrated in FIGS. 1-4. The reclosable plastic carton is substantially sealed, and may be hermetically sealed, such as by using heat welding, thus avoiding the need to glue the carton together, and is made of a plastic material that is compatible with use in food contact. The plastic carton eliminates the need for addition of an inner liner bag because the plastic carton provides the barrier properties of the liner, and thus can reduce cost and manufacturing effort. The cartons are assembled from a one-piece blank. The top opening may initially be sealed with a tamper-evident barrier film, and a reclosable lid can be provided to permit reclosing of the carton to help maintain the freshness of the food after the carton is initially opened.

Figure 1A:
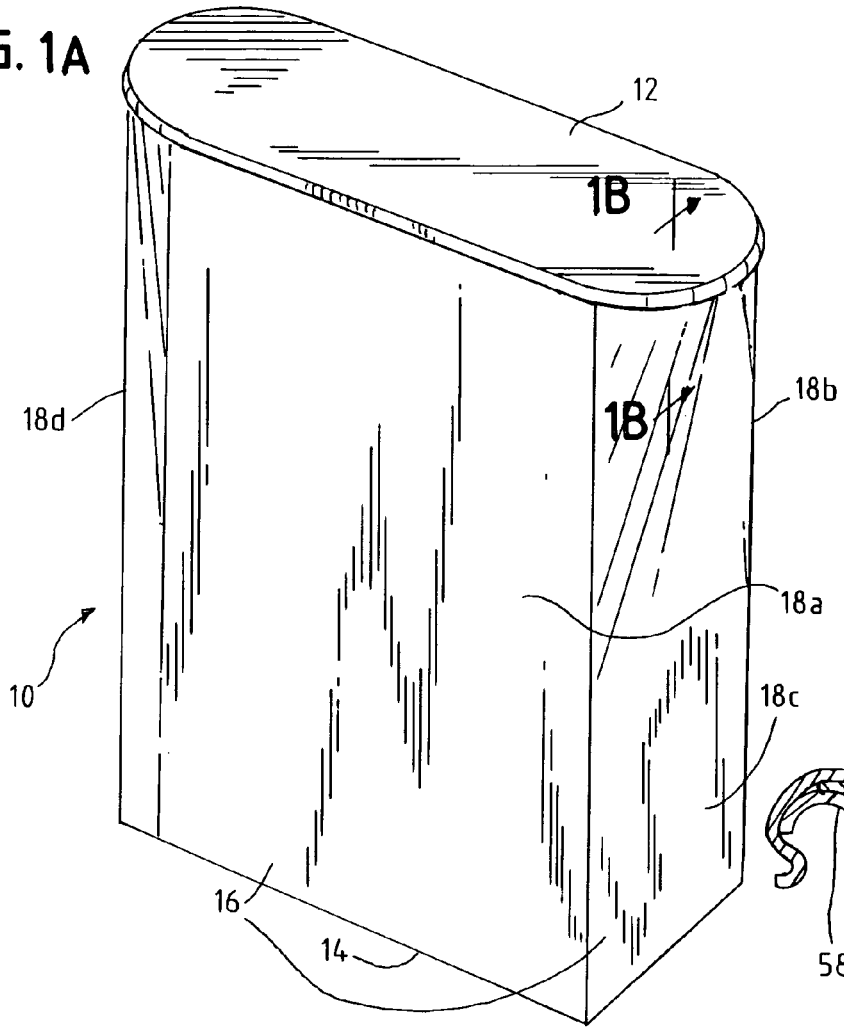
FIG. 1A is a perspective view of an assembled reclosable plastic carton.

The reclosable plastic carton 10, as illustrated in FIG. 1A, is made of a plastic sheet blank 20 that is folded and assembled into a carton 10. The carton 10 has an interior and an exterior area; the interior area is used for containing food and the exterior area is suitable for application of printing, such as prior to or after formation of the carton, and labels that convey what type of product is packaged inside.

The carton is generally sized about the same as typical cereal cartons, although other sizes of the carton can be made. The carton has a front panel 18*a* and a back panel 18*b*, and two side panels 18*c* and 18*d* connecting the front panel 18*a* to the back panel 18*b*. The bottom 14 of the assembled carton 10 is generally rectangular. The top of the carton 10 has a non-rectangular shape; in particular it may be an oval shape. The top edge of the carton 10 has a rolled lip or rim 58 about the periphery of the top opening 44 (see FIG. 1B). The rolled rim 58 is designed to receive a lid 12, which may be a reclosable lid or a hinged lid that is configured to mate with the rim 58. A film can be placed across the top opening before the lid 12 is placed thereover to provide an initial seal.

The carton 10 preferably provides similar barrier properties as that of a liner bag and eliminates the need of an additional bag inside of the carton 10. The plastic carton 10 may be made from materials such as polypropylene, high density polyethylene, and polyethylene terephthalate, as well as possibly including multiple layers thereof and still further a barrier layer, such as ethylene vinyl alcohol. The carton may also be made from a material having a plastic coating. The carton 10 is generally used to package cereals, snack crackers, cookies, rice, stuffing, cake mixes, dry desserts, and other similar dried foods, but may also be used for various other foods such as coffee and instant beverage powders.

Figure 2:
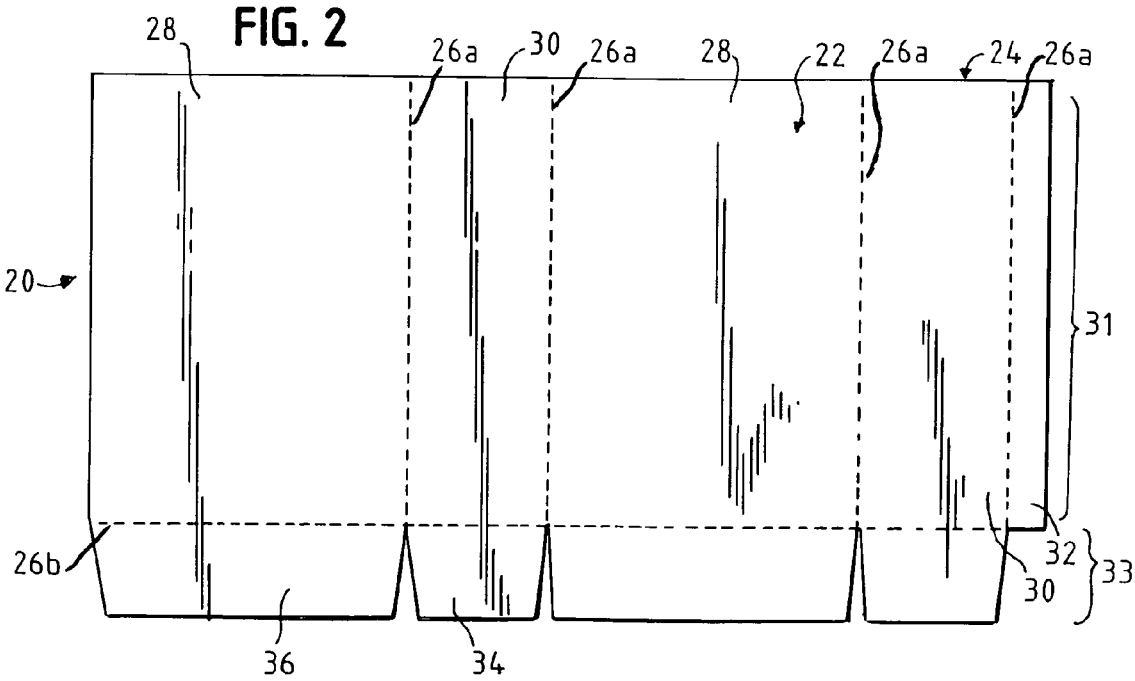
FIG. 2 is a plan view of a plastic carton blank prior to assembly.

In its unfolded configuration, the plastic carton blank 20, as shown in FIG. 2, is a unitary sheet of plastic with an inner side 22 and an outer side 24. The material of construction used for the carton blank 20 is preferably polypropylene, but alternatively other types of plastic carton material may be used that can be folded into a carton and sealed, as discussed herein. The outer side 24 of the blank 20 may be pre-printed with indicia and the inner side 22 may be marked with scored lines 26*a* and 26*b* to aid in folding of the blank 20. In addition, one or more scored lines may be made in the corners to help create a smoother radius when folded. The inner side 22 of the blank 20 defines the interior area of the assembled carton 10, and the outer side 24 of the blank 20 becomes the exterior area of the carton 10.

The scored lines 26*a* and 26*b* divide the unitary carton blank 20 into various segments or panels such that there are at least four bottom flaps 33 and at least four side panels 31 in a coplanar arrangement. The two larger width panels represent the major side panels 28 and the two smaller width panels represent the minor side panels 30. The major side panels 28 comprise one front panel and one back panel and the minor side panels 30 are disposed therebetween when the carton blank 20 is erected into the carton 10. Preferably the carton blank 20 has a secondary side panel 32 that is of a narrower width than the major and minor side panels 28 and 30, but is about the same length as the major and minor side panels 28 and 30. Alternatively, the score lines 26*a* may be split into two lines between adjacent side panels, instead of one, with the score line starting out as a single line from the bottom flaps and splitting into two lines about one-third of the way from the bottom flaps. This split score line may further aid in facilitating the formation of the round carton edges, which are discussed below.

Adjacent the set of side panels 31, including the major side panels 28, the minor side panels 30, and the secondary side panel 32 is a set of flaps 33 for forming the bottom of the carton 10 when assembled. The flaps 33 include a pair of major bottom flaps 36 and a pair of minor bottom flaps 34. The major bottom flaps 36 are approximately the same width as the major side panels 28 and are attached via a fold or score line 26*b* thereto; the bottom minor flaps 34 are approximately the same width as the minor side panels 30 and are likewise attached to the bottom fold or score line 26*b* of the minor side panels 30. The width of each flap 33, parallel to the fold line 26*b*, decreases between the fold line 26*b* and the opposite end of each flap 33. The decreasing widths of the flaps 33 result in tapered side edges which provide a clearance spacing between edges of adjacent flaps 33 when folded perpendicular to the side panels 31. The angle of taper of each side may be between about 1 and 5 degrees, and is preferably about 3 degrees. If the angle of taper is about 3 degrees then the total tapered angle between two adjacent flaps would be about 6 degrees.

In one particular example, the unfolded carton blank 20 may generally consist of a sheet from about 14 inches to about 18 inches in width and from about 7.3 inches to about 11.3 inches in length, more preferably the dimensions are about 16 inches by 9.30 inches; the width of the blank 20 also includes the width of the secondary side panel 32. The vertical length of the individual major side panels 28 and the minor side panels 30 as well as the secondary side panel 32 may be from about 5.7 inches to about 9.7 inches, more preferably about 7.7 inches. The major side panels 28 may have a width of about 3.3 inches to about 7.3 inches, more preferably about 5.3 inches. The minor side panels 30 may have a width of about 0.5 inches to about 4.5 inches, more preferably about 2.5 inches. Each individual side panel forms a substantially straight-edged rectangle. The secondary side panel 32 has the same length as the side panels, but a width much smaller; from about 0.25 inches to about 1 inch, more preferably about 0.50 inches. The major bottom flaps 36 and the minor bottom flaps 34 each have a vertical length of from about 0.50 inches to about 3.5 inches, more preferably at about 1.5 inches. The width of the major bottom flaps 36 and the minor bottom flaps 34 is similar to the widths of the major 28 and minor 30 side panels, respectively. Although these dimensions are described for one particular example, these dimensions may be varied to obtain other carton sizes.

Turning now to the assembly of the carton blank 20, each of the side panels 31 are folded along the score lines 26*a* into a generally perpendicular arrangement with the adjacent side panels 31. A heat source, such as an ultrasonic or standard conduction heat source, is applied to the outer exterior side 24 of the blank 20 where the secondary side panel 32 and the major side panel 28 overlap. The application of a heat source, preferably a heat bar, to the outer exterior side 24 heat seals the secondary side panel 32 to the interior of the major side panel 28. The seal is formed by heating the polypropylene carton material to form a bond between the secondary side panel 32 and the interior of the major side panel 28. The temperature of the heat source depends upon the melting point of the type of carton material and may be the same as or slightly higher than the melting point temperatures of the carton material, with melting points varying from about 230° F. to about 485° F., and preferably from about 250° F. to about 350° F. The temperature of the heat source used to form the rolled rim of the carton needs only to reach a deflection temperature or Vicat softening point, which for example, may be about 100° F. to about 200° F. for polypropylene. Alternatively, a separate heat-activated coating or sealant layer may be applied to the blank 20 to aid in forming the seals.

Figure 3A:
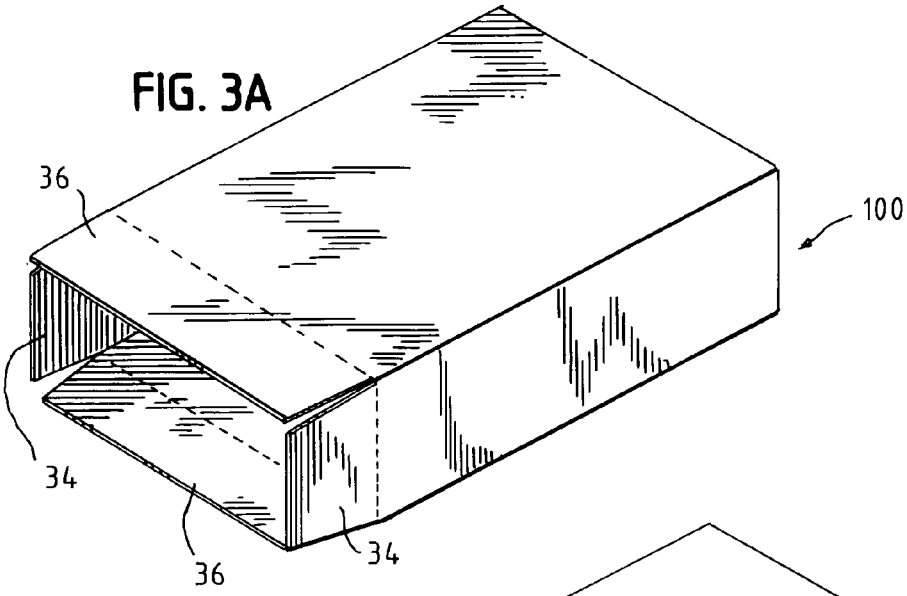
FIG. 3A is a perspective view of the plastic carton blank of FIG. 2 with major side panels folded into perpendicular orientations relative to minor side panels and a secondary side panel sealed to one of the major side panels.
Figure 3B:
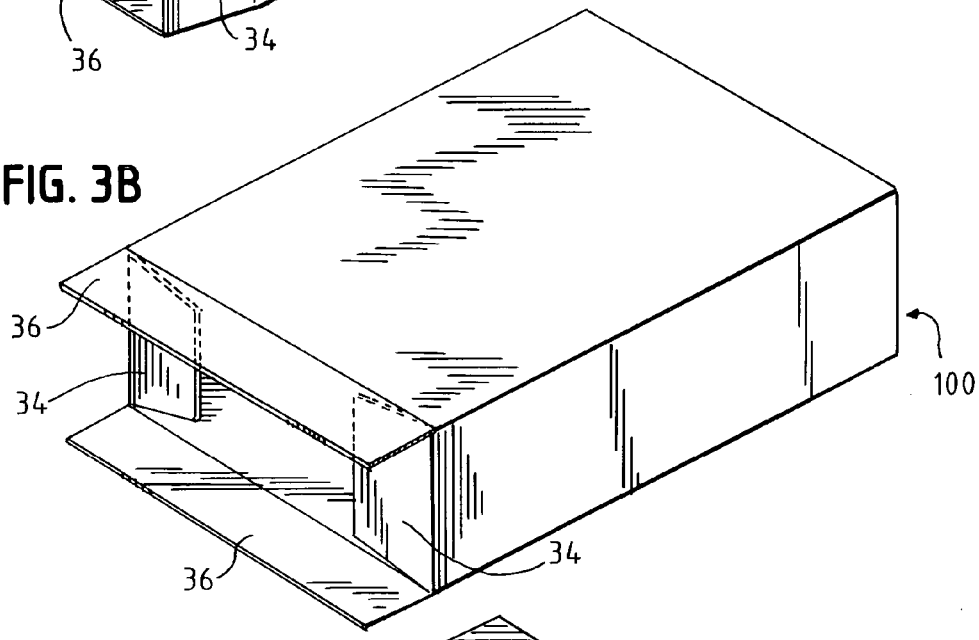
FIG. 3B is a perspective view of the plastic carton of FIG. 3A with the minor bottom flaps folded into perpendicular orientations relative to the side panels.

After folding the side panels 31 and sealing the secondary side panel 32 to the major side panel 28, the carton blank 20 has been converted to the partially assembled, erect configuration having open ends, such as illustrated in FIG. 3A. Prior to being erected, but after the sealing of the secondary side panel 32 to the interior of the major side panel 28, the collapsed carton may have a first set of the major and minor side panels generally coplanar and a second set of the major and minor side panels generally coplanar, with the first set partially overlying the second set. From this collapsed configuration, the carton can be shifted to the erect configuration illustrated in FIG. 3A.

Figure 3C:
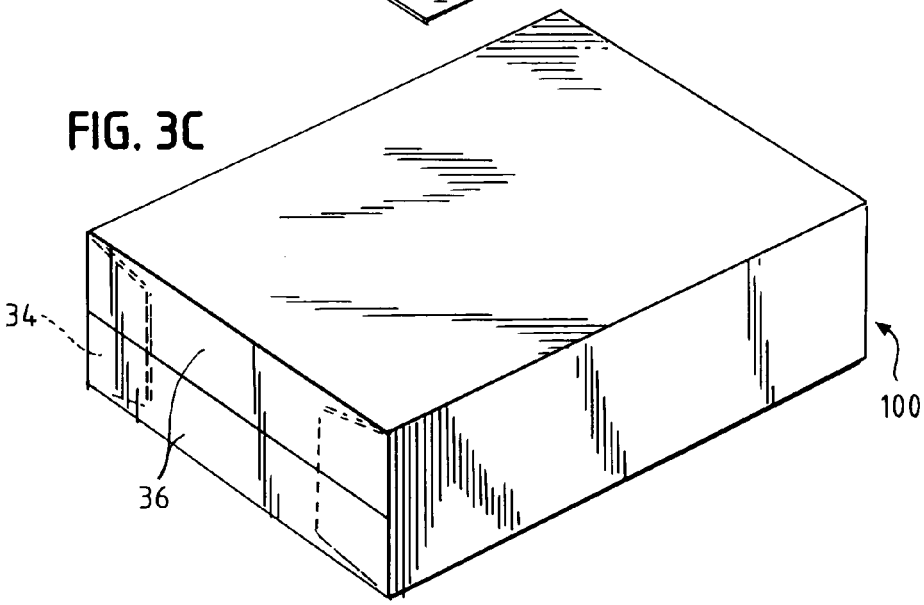
FIG. 3C is a perspective view of the plastic carton of FIG. 3B with the major bottom flaps folded into perpendicular orientations relative to the side panels.

From the erect configuration, the major bottom flaps 36 and minor bottom flaps 34 are folded such that they are substantially normal to the respective side panels 31. A guide or folding arm may be used to fold the two minor bottom flaps 34 (see FIG. 3B) as the carton 100 is directed along a conveyor. Another guide or folding arm may be used to fold the two major bottom flaps 36 against the minor bottom flaps 34, as the carton is continued to be directed along the conveyor to result in a folded carton 100 that is generally rectangular, as shown in FIG. 3C.

A forming tool 40 is used to shape the opening 44 of the carton 100 and assist in the sealing of the bottom flaps 33 to each other. More specifically, a bottom anvil 48 is used to assist in the sealing of the bottom flaps 33 to each other. The bottom anvil 48 is attached to one end of a reciprocating rod 50 and can be inserted and removed from the interior of the carton 100, as designated by the direction of arrows A and B. When inserted, the bottom anvil 48 is pressed against the interior side of the bottom flaps 33 to provide a backing surface against which a heated sealing bar 42 can press the flaps 33 to seal the bottom 60, as described in greater detail below. The top mandrel 46 is independently slidable along the reciprocating rod 50, also designated by the direction of arrows A and B, and can be selectively applied to the opening 44 of the carton 10 to both reshape the rectangular opening 44 into a rounded opening and to form a rim or lip at the edge of the carton opening 44. The top mandrel 46 may be heated to assist in forming the rim and shaping the carton opening.

Figures 3D, 3E, 3F:
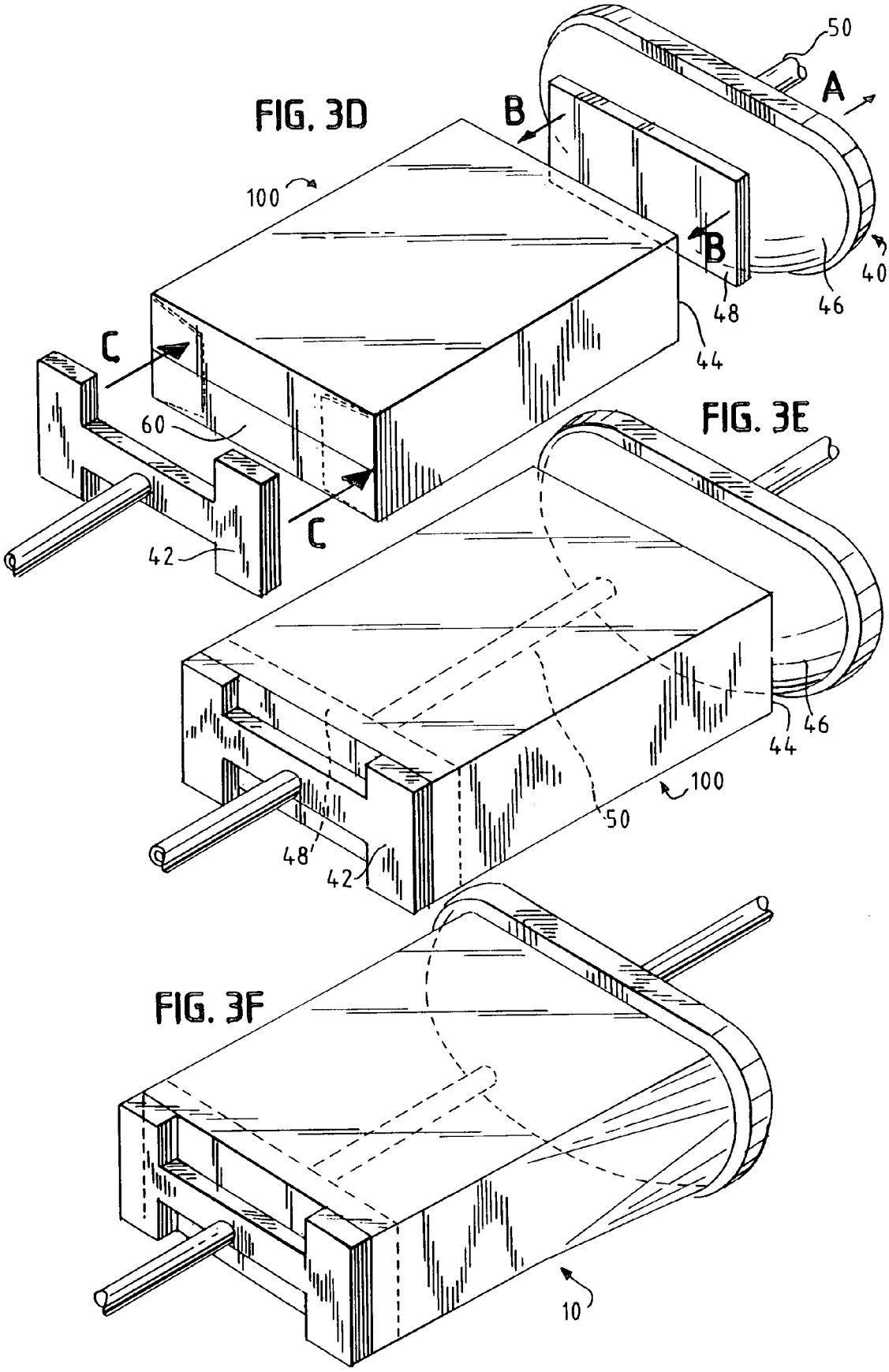
FIG. 3D is a perspective view of the plastic carton of FIG. 3C prior to sealing the bottom flaps, and showing a heated sealing bar, anvil and a mandrel.
FIG. 3E is a perspective view of the plastic carton of FIG. 3D, with the heated sealing bar applied against the exterior of the bottom flaps and the anvil applied against the bottom interior.
FIG. 3F is a perspective view of the plastic carton of FIG. 3E, with the mandrel shaping the opening and forming the rim.

Turning now to the use of the forming tool 40, the bottom anvil 48 of the forming tool 40, as shown in FIG. 3D, is inserted through the top opening 44 into the interior of the carton 100, and pressed against the folded bottom flaps 33 from the inside of the carton 100. The bottom anvil 48 of the forming tool 40 is substantially rectangular and sized to generally match the shape of the bottom 60 of the carton 100.

Once the bottom anvil 48 of the forming tool 40 is placed against the flaps of the bottom interior of the carton 100, the heated sealing bar 42 is pressed against the bottom 60 from the exterior area of the carton 100, as shown in FIG. 3E. The heated sealing bar 42 presses the flaps against the bottom anvil 48 in the direction of arrow C and heats the bottom flaps 60 to create a substantially sealed carton bottom 60.

Figure 1B:
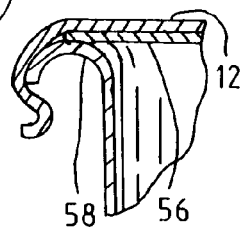
FIG. 1B is a sectional view of the rim of the carton and the lid taken along line 1B-1B of FIG. 1A.

Subsequent to sealing the bottom flaps or simultaneously therewith, a rounded portion of the top mandrel 46 of the forming tool 40 is inserted into the carton interior through the carton opening 44, as shown in FIG. 3F. The rounded portion of the top mandrel 46 of the forming tool 40 has an oval shape. In addition, the mandrel 46 has a rim forming portion for shaping the edges of the carton opening 44 into the rim 58. The rim forming portion of the mandrel 46 includes surfaces, such as a flat surface or a channel, for rolling the edges of the carton opening 44 into a curved shape, which becomes the rim 58, such as illustrated in FIG. 1B. The rim 58 has a width that preferably will be greater than the thickness of the side panels 31.

The top mandrel 46 is orientated such that its lower section protrudes into the interior of the carton 100 causing the side panels 31 near the opening 44 to become slightly curved and to bulge out in order to accommodate a round opening. The curve of the side panels near the opening 44 may further be aided in its formation by the addition of split score lines between adjacent side panels, as previously discussed. Once all the seals have been formed and the rim 58 has been made, the forming tool 40 and heat sources are removed from the interior of the carton 10.

Figure 4:
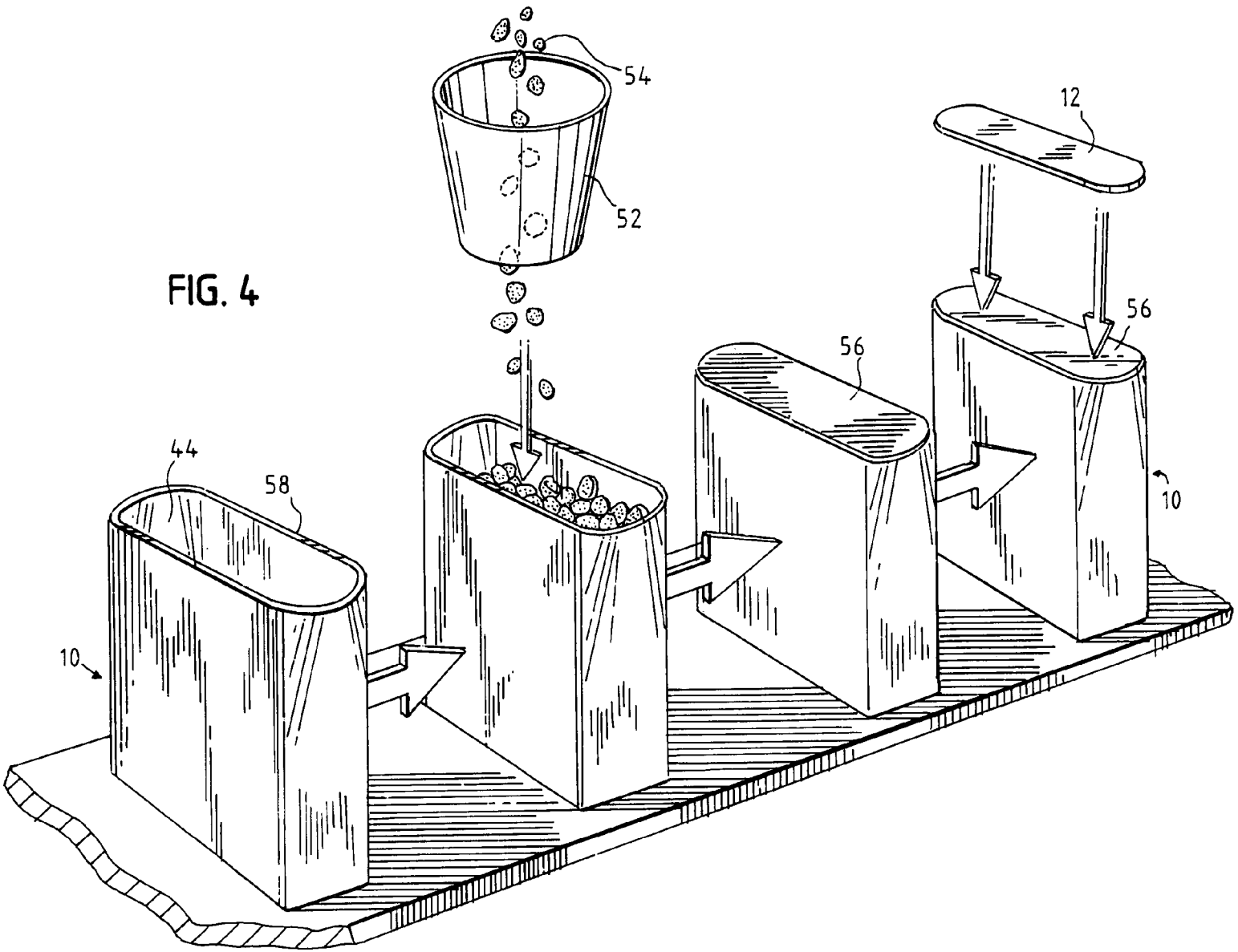
FIG. 4 is a perspective view of a flow diagram of a filling and sealing process of the formed plastic carton of FIG. 1.

Subsequent to the carton 10 formation, the carton 10 is filled with a food product 54, as shown in FIG. 4. Any known filling means may be utilized to add the food product 54 to the interior of the carton 10, such as, for example, a funnel 52. After the carton 10 has been filled, a seal or barrier film 56 may be placed over the opening 44 of the carton 10 and attached to the rim to seal the opening 44, and maintain product freshness prior to opening of the carton 10. In addition, the presence of the barrier film 56 can provide evidence that the carton 10 has not previously been opened. Once the barrier film 56 is in place a lid 12 may be placed over it. The lid 12 may be either hinged or snapped on and may have a recessed channel about the periphery of an underside of the lid 12 designed to receive the rim 58. To open the package, the reclosable lid is removed and then the barrier film, and to close the carton the reclosable lid is snapped back down over the opening to substantially reseal the carton 10.

From the foregoing, it will be appreciated a reclosable plastic carton is provided that allows for storing food directly in the carton without also requiring a bag liner to maintain freshness or to separate it from the carton, and for permitting removal of a quantity of food and allowing continued storage of the remaining food while maintaining its freshness. However, the disclosure is not limited to the aspects and embodiments described hereinabove, or to any particular embodiments. Various modifications to the carton, the blank, and methods of assembling can result in substantially the same carton.

What is claimed is:

1. A method for forming a carton from a unitary blank in a collapsed configuration, the blank having a pair of major side panels and a pair of minor side panels adjacent one another and a pair of major bottom flaps and a pair of minor bottom flaps attached to the side panels at a lower end thereof, and a secondary side panel attached lengthwise to an outer edge of one of the major or minor side panels, the collapsed configuration having each of the major side panels generally coplanar with one of the minor side panels and the bottom flaps each coplanar with the attached major or minor side panel, the method comprising the steps of:

shifting the blank from the collapsed configuration to an upright configuration where the major and minor side panels are substantially normal to attached major and minor side panels;

folding each of the bottom flaps into configurations substantially normal to the attached side panels;

applying a heat source to the bottom flaps to form seals therebetween; and applying a heat source to an opening defined by upper edges of the major and minor side panels opposite the bottom flaps to shape the upper edges into a non-rectangular periphery and to form a curved rim about the upper edges.

2. A method of forming a carton from a unitary blank in a collapsed configuration in accordance with claim 1, including the steps of applying a heat source to the secondary side panel and to one of the major side panels or minor side panels that overlap the secondary side panel to substantially seal the panels to each other.

3. A method of forming a carton from a unitary blank in a collapsed configuration in accordance with claim 1, wherein the heat source is applied with an ultrasonic heat source or a standard conduction heat source.

4. A method of forming a carton from a unitary blank in a collapsed configuration in accordance with claim 1, wherein the heat source is applied to the bottom flaps from an exterior side of the carton and a forming tool having an anvil is inserted into the interior of the carton and pressed against the bottom flaps of the carton from the interior as the heat source is applied to create a substantially sealed bottom.

5. A method of forming a carton from a unitary blank in a collapsed configuration in accordance with claim 4, wherein the forming tool has a top mandrel independent of a bottom anvil for shaping the upper edges of the major and minor side panels into the non-rectangular periphery and to form the curved rim.

6. A method of forming a carton from a unitary blank in a collapsed configuration in accordance with claim 5, wherein the bottom anvil is attached to a rod and the top mandrel is slidable along the rod to enable the independent placement of the bottom anvil and top mandrel.

7. A method of forming a carton from a unitary blank in a collapsed configuration in accordance with claim 1, including the steps of inserting a food product into the carton, adhering a film to the rim of the carton to cover the opening, and adding a lid to the rim to cover the film.

8. A method of forming a carton from a unitary blank in a collapsed configuration in accordance with claim 7, wherein the carton blank is made of a material that is heated and seals upon itself when the heat source is applied.

9. A method of forming a carton from a unitary blank in a collapsed configuration in accordance with claim 7, wherein a separate heat-activated coating is applied to the carton blank to aid in forming the seals along the panels and flaps.

10. A method of forming a carton from a unitary blank in a collapsed configuration in accordance with claim 1, wherein the carton blank is made of polypropylene.

* * * * *